US010405648B2

(12) United States Patent
Pappas et al.

(10) Patent No.: US 10,405,648 B2
(45) Date of Patent: Sep. 10, 2019

(54) FURNITURE WITH REMOVABLE ELECTRONICS RACK

(71) Applicant: Middle Atlantic Products, Inc., Fairfield, NJ (US)

(72) Inventors: Andreas Pappas, Butler, NJ (US); Dean Wheelan, Pompton Lakes, NJ (US)

(73) Assignee: Legrand AV Inc., Fairfield, NJ (US)

( * ) Notice: Subject to any disclaimer, the term of this patent is extended or adjusted under 35 U.S.C. 154(b) by 0 days.

(21) Appl. No.: 15/970,505

(22) Filed: May 3, 2018

(65) Prior Publication Data

US 2018/0332956 A1 Nov. 22, 2018

Related U.S. Application Data

(60) Provisional application No. 62/509,465, filed on May 22, 2017.

(51) Int. Cl.

| | |
|---|---|
| ***A47B 21/04*** | (2006.01) |
| ***A47B 19/00*** | (2006.01) |
| ***A47B 19/02*** | (2006.01) |
| ***A47B 88/42*** | (2017.01) |
| ***A47B 88/48*** | (2017.01) |
| *A47B 88/483* | (2017.01) |

(52) U.S. Cl.

CPC ..... *A47B 21/04* (2013.01); *A47B 19/00* (2013.01); *A47B 19/02* (2013.01); *A47B 88/42* (2017.01); *A47B 88/483* (2017.01); *A47B 2200/0083* (2013.01); *A47B 2210/0056* (2013.01)

(58) Field of Classification Search

CPC ..... A47B 19/00; A47B 19/02; A47B 19/10; A47B 21/04; A47B 13/00; A47B 88/42; A47B 88/0485; A47B 88/483; A47B 88/12; A47B 88/407; A47B 88/0407; A47B 2097/006; A47B 2200/008; A47B 2200/0083; A47B 2210/0056; A47B 2088/4235; A47B 2088/0444; H05K 7/1421; H05K 7/1488; H05K 7/1489; H02B 1/36

USPC ..... 211/26

See application file for complete search history.

(56) References Cited

U.S. PATENT DOCUMENTS 2,815,252 A * 12/1957 Baker ..... C09J 7/20 384/23

3,056,641 A 10/1962 Parmet (Continued)

FOREIGN PATENT DOCUMENTS

DE 29709875 U1 * 11/1997 ..... G06F 1/181

GB 673092 A * 6/1952 ..... H05K 7/1421

(Continued)

OTHER PUBLICATIONS

International Search Report and Written Opinion dated Aug. 1, 2018 (corresponding International Appl. No. PCT/US2018/031781).

*Primary Examiner* — Andrew M Roersma

(74) *Attorney, Agent, or Firm* — Drinker Biddle & Reath LLP

(57) ABSTRACT

A piece of furniture, such as a lectern, has a shell with an opening. A rack for electronic equipment is mounted within the shell. The rack can be slid between a stowed position in which the rack is entirely within the furniture and an access position in which the rack extends through the opening and is partially outside the shell.

10 Claims, 3 Drawing Sheets

(56) References Cited

U.S. PATENT DOCUMENTS

| | | | | | |
|---|---|---|---|---|---|
| 5,443,312 | A * | 8/1995 | Schluter | H02B 1/36 | 312/201 |
| 5,808,866 | A | 9/1998 | Porter | | |
| 6,092,885 | A * | 7/2000 | James | A47B 19/00 | 312/140.2 |
| 6,219,249 | B1 | 4/2001 | Tuccio et al. | | |
| 7,277,273 | B2 * | 10/2007 | Smith | H05K 7/1488 | 211/26 |
| 7,439,694 | B2 | 10/2008 | Atlas et al. | | |
| 7,874,538 | B2 | 1/2011 | Atlas et al. | | |
| 8,152,249 | B2 * | 4/2012 | Becklin | H05K 7/1421 | 312/223.1 |
| 8,297,450 | B2 * | 10/2012 | Zavidniak | H05K 7/183 | 211/13.1 |
| 2013/0091689 | A1 * | 4/2013 | Mimlitch, III | H05K 7/1488 | 29/525.01 |
| 2014/0332647 | A1 * | 11/2014 | Tai | F16B 5/07 | 248/205.1 |
| 2016/0088757 | A1 | 3/2016 | Aldridge et al. | | |

FOREIGN PATENT DOCUMENTS

| | | | | |
|---|---|---|---|---|
| GB | 2229317 | A * | 9/1990 | H02B 1/301 |
| GB | 2438900 | A | 12/2007 | |
| JP | S-63100907 | U * | 6/1988 | |

* cited by examiner

FURNITURE WITH REMOVABLE ELECTRONICS RACK

RELATED APPLICATION

This application is related to and claims priority from U.S. Provisional Application No. 62/509,465, filed May 22, 2017, the disclosure of which is incorporated herein by reference in its entirety.

FIELD OF THE INVENTION

The invention relates to furniture and, more particularly, a piece of furniture with a removable rack for mounting and storing electronic equipment.

BACKGROUND

It is well known for certain furniture, such as s lectern or cabinet, to be in the form of a box, with a top surface for a speaker's or user's materials, and a storage space below that may be open on the side facing toward the user (and away from the audience in the case of a lectern). For example, it has recently become common for lecterns to be provided with outlets for electrical power and electronic data, and interfaces for audio-visual equipment to be provided in the top surface of the lectern, accessible to the speaker with wired connections to such outlets to be fed up and down through the body of the lectern. It is also known for audio-visual and other electronic equipment to be mounted within the body of the lectern. That arrangement has an advantage aesthetically in that the wiring and any stored equipment are hidden from view, that the wiring and equipment are protected from the feet of users of the room, and the users are protected from bumping into the equipment or being tripped by the wiring. In such furniture, the electronics are generally stored on shelves mounted inside the lectern enclosure.

However, with conventional furniture, such as lecterns, access to equipment within the furniture lectern can be difficult and, with the increase in the need for different types of electrical components, can lead to haphazard placement of electronics on top of each other on the shelving. This can also lead to heating issues and confusing wiring runs.

There is, therefore, a need for a furniture, with internally mounted electronics, to have better access.

SUMMARY

In one aspect, there is provided a piece of furniture, such as a lectern, with a removable electronics rack, comprising a shell with a front wall, an open back, side walls, and a base attached to the front and the side walls. The shell defines an interior cavity. A rack for electronic equipment is removably mounted on the base within the interior cavity of the shell. The rack is slidable between a stowed position in which the rack is entirely within the internal cavity of the shell and an access position in which the rack extends through the open back and is partially outside the shell. The rack has a front rail with a handle extending outward and two vertical supports, each vertical support being attached at its bottom to a side end of the front rail and extending upward therefrom. The rack includes two side rails, each side rail being attached at one end to the bottom of one of the vertical supports. There are preferably two additional vertical supports, one attached to each of other ends of side rail such that there is a vertical support in each corner of the rack. A rear rail is attached to the vertical supports on the opposite side of the rack from the front rail. The lectern includes a guide assembly for guiding the rack between its stowed position and its access position. The guide assembly is configured to limit travel of the rack on the base to a horizontal direction. The guide assembly preventing removal of the rack from the base in the stowed position thereby securing the rack to the shell and preventing removal of the rack in the vertical direction until the rack is in its access position.

In an embodiment, the guide assembly includes a guide base mounted to the base of the shell, the guide base having an internal channel, and a guide slider mounted to a back surface of the front rail and projecting rearward from the front rail. The guide slider having an elongated shape that mates with the internal channel of the guide base so that the guide slider slides in to and out of the guide base. The elongated shape of the guide slider is configured to limit the travel of the rack relative to the base to a horizontal direction until such time as the elongated guide slider is no longer within the internal channel of the guide base.

In an embodiment, the rack in its access position is releasable from the furniture and, when released, can be lifted out of the opening. In a further embodiment, at the access position when released, the rack rests on a floor of the furniture with a center of gravity of the rack forward of (inside the shell relative to) a rear edge of the floor.

In an embodiment, the furniture includes a locking mechanism which, in an embodiment, is a thumbscrew threaded through the front rail and into a threaded hole in an upstanding bracket on the guide base.

In an embodiment, the top of the lectern is provided with a top surface for supporting materials used by a user using the furniture, has a wall raised above the top surface except on a rear side intended to face towards the user and, in the case of a lectern, away from the audience, and the opening is on the rear side.

In an embodiment, the opening is preferably in a generally flat rear face of the lectern, the rack is cuboidal, and a large face of the rack is parallel to the flat face of the pedestal.

In an embodiment, the furniture is in the shape of a rectangle as seen in plan view, and the opening occupies a major portion of a long side of the rectangle.

In an embodiment, the furniture is optionally mounted on wheels or casters.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION

Figure 1:
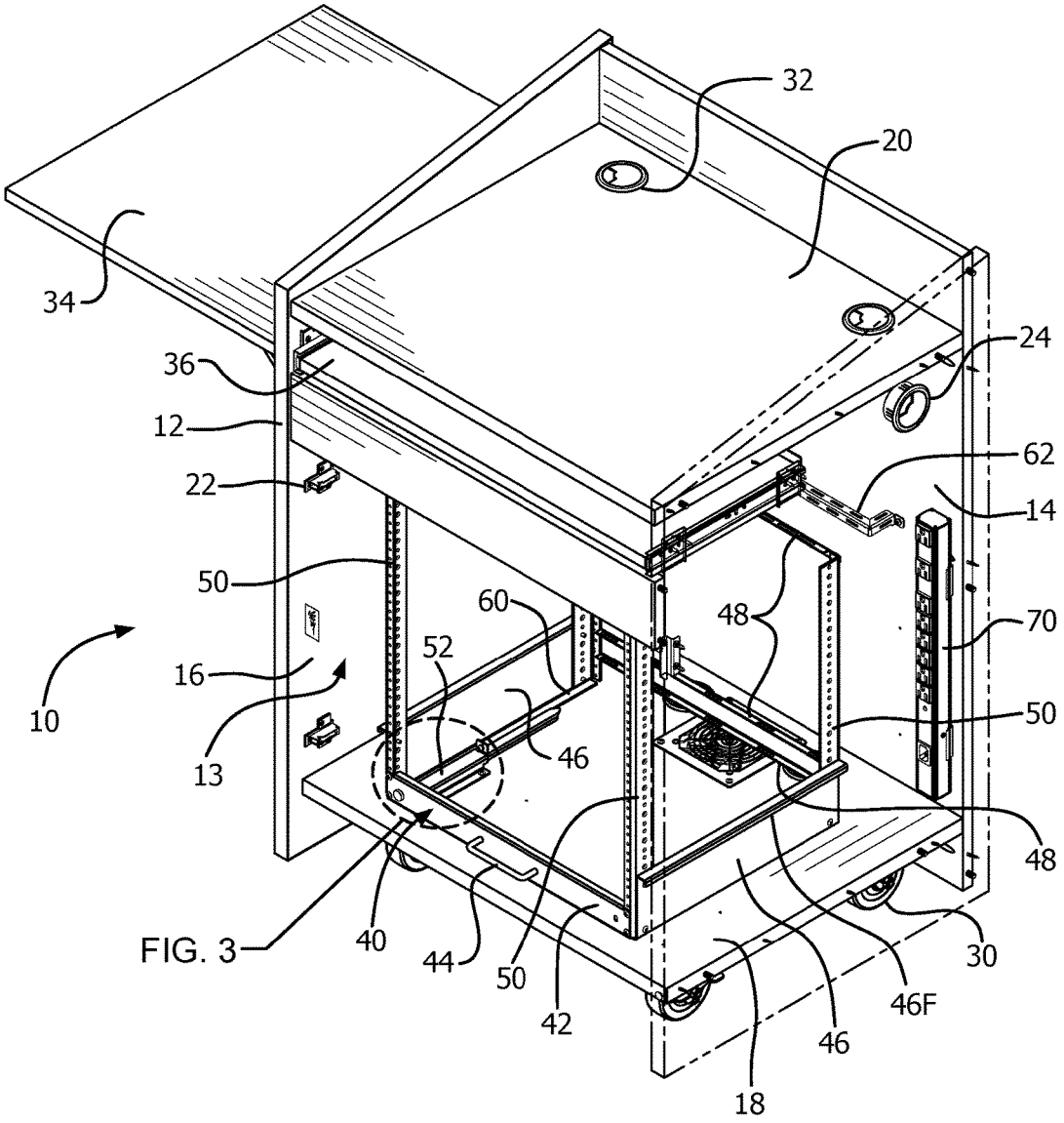
FIG. 1 is a perspective view of a piece of furniture, such as a lectern, with a rack in a stowed position.

The following description focuses on an embodiment of the invention in the form of a lectern. That is, however, just one embodiment of the invention as those skilled in the art will readily appreciate that the invention is applicable to various forms of furniture. Referring to the drawings, and initially to FIGS. 1 and 2, a lectern indicated generally by the reference numeral 10 comprises a shell 12 which, in one embodiment, is preferably generally rectangular in cross-section, and comprises a front wall 14, two side walls 16, one of is shown in phantom for clarity, a base 18, and a top 20. In this description, it is assumed that the "front" wall 14 is intended to face an audience (not shown), and that a speaker (not shown) stands at the "rear" or "back" side, facing towards the audience across the lectern. A rear side of the shell 12 is open, and may be provided with a door or pair of doors, or a removable cover, not shown, mounted on hinges 22 or other appropriate fastenings. While a rectangular lectern is shown in the drawings, the present invention is not limited to any particular shape. Thus, for example, the invention described herein can be applicable to lecterns having curved surfaces or walls. The shell 12 has an interior cavity 13.

The front wall 14 and side walls 16 are preferably solid, except where openings are needed for specific purposes, in order to protect equipment inside the shell 12 and to minimize or prevent viewing of the equipment from outside the shell. In particular, because the front wall 14 faces towards the audience, it is generally desirable for its external appearance to be provided with a decorative or informative external finish. As shown, one side wall 16 may have a small port 24 to allow cables to enter or leave or provide for heat dissipation.

Figure 2:
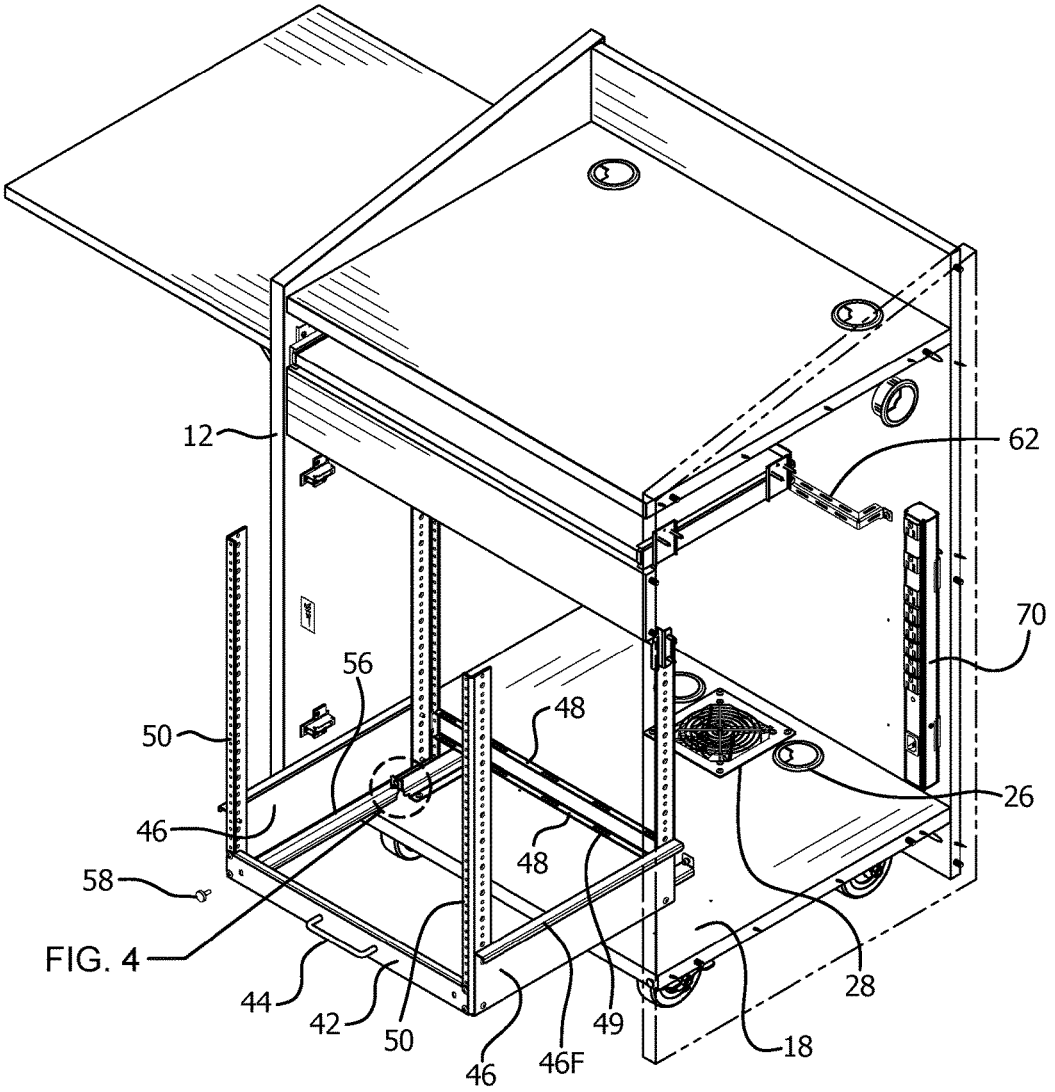
FIG. 2 is a perspective view of the furniture of FIG. 1 with the rack in the access position and released.

In FIG. 1, the base 18 is solid, and is provided with ports 26 for cables, which cables may then be plugged into, for example, receptacles in the floor, to supply power and/or data to the lectern 10 or to enable equipment or controls on the lectern 10 to operate audiovisual or other equipment external to the lectern. The base 18 is also provided with a port for a cooling fan 28 to draw air out of or into the interior of the lectern. On the underside of the base 18 are preferably wheels and/or casters 30.

As shown in FIG. 1, the top 20 is flat and horizontal, and has ports 32 for cabling to the interior of the shell. Instead, or in addition, the top 20 may be provided with control and/or display equipment, or receptacles for power and/or data cables. The rear wall 14 and the side walls 16 extend below the base 18 to conceal the wheels or casters 30, without grounding on the floor, and extend above the top 20, to conceal a speaker's materials. Instead, or in addition, a portion of the top 20 may be angled in a conventional manner.

A shelf 34 may optionally extend from a side of the lectern 10, and can be stowed either by hinging it down into a vertical position against one side wall 16, or by sliding it into the shell 12 through a slot in the side wall 16. If the shelf 34 slides into the shell, it is shorter and/or narrower than the width of the shell 12, so that there is room for cabling to pass round it along the front wall 14 or the opposite side wall 16. A shallow shelf 36 may optionally be included and configured to slide out from the rear of the lectern 10, at a location spaced below the top 20 far enough for a keyboard to sit on the shelf 36 in a retracted position below the top 20.

A rack for electronic units, such as audio/video, telecommunication and computer components, is generally indicated by the reference numeral 40. The rack 40 is located within the interior cavity 13 of the shell 12. In one embodiment, the rack 40 includes a front rail 42 with a handle 44, two side rails 46, at least one rear rail 48, and at least two vertical supports 50 that extend upwards from the corners where the front rail 42 meets the side rails 46. The vertical supports 50 are attached to either end of the front rail 42, preferably through the use of bolts or screws. However, it is also contemplated that the components could be welded to one another. Similarly each side rail 46 attaches at one end to a vertical support 50 through crews or bolts. The side rails 46 may include flanges $\mathbf{46}_F$, that provide stiffening for the side rail and a convenient ledge for use as a handle when lifting the rack. The rear rails 48 attach to either the side rails 46 or, more preferably, to additional vertical supports 50 that extend upwards from the corners where the rear rail 48 meets the side rails 46. As shown, there can be multiple rear rails 48 attached to the rear vertical supports 50 which provide mechanisms for cable management as will be discussed below. The rear rails 48 are attached in a similar manner as the other rails discussed above.

The vertical supports 50 are provided with holes to which units of electronic equipment (not shown) can be attached, such as by bolts, screws or other conventional fasteners, with the mounted equipment extending forwards above the side rails 46 and rear rail 48. Alternatively or in addition, one or more of the rails may include apertures configured to interconnect with a Lever Lock® locking mechanism for removable securing components. The Lever Lock® locking mechanism is described in U.S. Pat. No. 9,131,622, the disclosure of which is incorporated herein by reference in its entirety. Additional structural members may be attached to the front, rear and side rails for increased strength and stiffness if desired. However, in practice, the units of electronic equipment are preferably mounted to the front rail 42 or the front vertical supports 50 for accessibility and are generally sufficiently shallow from front to rear that the weight is close to the vertical supports 50 that are attached to the front rail, and additional stiffening may not be needed.

Figure 4:
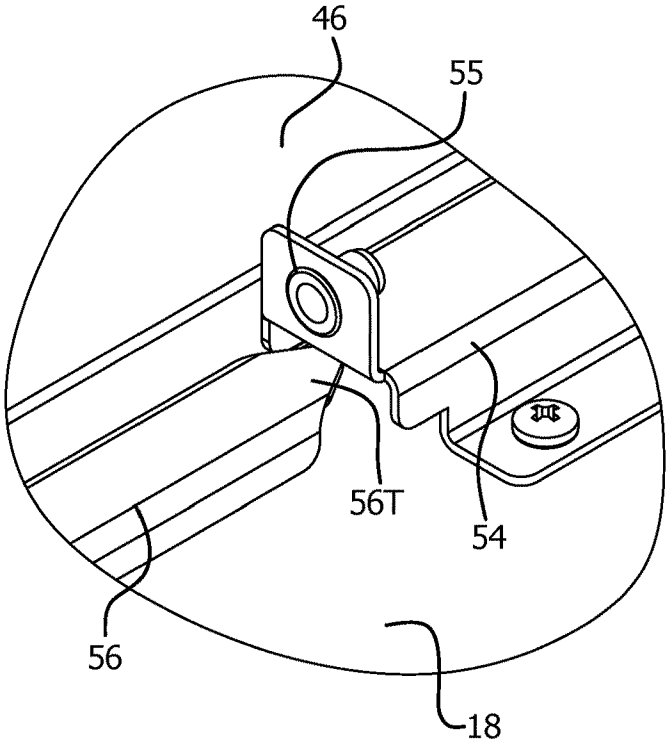
FIG. 4 is an enlarged detail of the guide assembly in FIG. 2 identified as FIG. 4.
Figure 3:
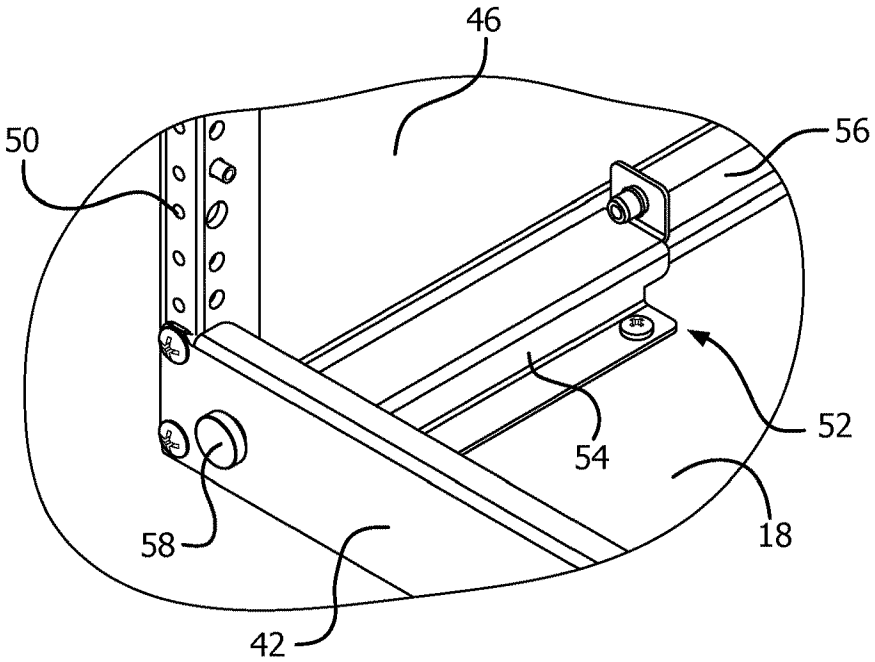
FIG. 3 is an enlarged detail of the guide assembly in FIG. 1 identified as FIG. 3.

Referring now to FIGS. 3 and 4, the rack 40 is mounted to the lectern through the use of at least one sliding rack guide 52. Preferably there are two sliding rack guides 52, one positioned near each rear corner of the rack. The sliding rack guide 52 comprises a guide base 54 that is fixed to the base 18 of the lectern, and a guide slider 56 attached to the rack, preferably the front facing side of the front rail 42, and engaged with the guide base 54. In one preferred embodiment, the guide base 54 includes an internal channel and the guide slider 56 has an external shape that is complementary to the channel such that the guide slider 56 mates with the channel of the guide base. As such, the guide slider 56 is adapted to slide within and be guided by guide base 54 so as to permit the rack 40 to move backwards and forwards relative to the guide base 54, between its stowed position (where the rack is located within the interior of the lectern) and an access position (where the rack is slid away from the lectern and the components on the rack 40 are accessible). As shown in FIG. 4, the guide slider 56 preferably has a rounded or pointed tip end 56T located furthest from the front rail 42. The shape of the tip end 56T helps guide the slider into the channel of the guide base 54.

A locking mechanism 58 is provided which secures the rack in the stowed position. In one preferred embodiment, the locking mechanism is at least one thumbscrew which is positioned on the front rail 42 that engages with a threaded hole in a bracket 55 on the guide base 54. While a thumbscrew locking mechanism is shown, it is also contemplated that the locking mechanism can be a keyed lock (such as a cylinder lock) or other conventional lockable mechanism so as to prevent removal of the rack from the lectern. For example, the keyhole portion of the lock could be on the front rail 43 and an engagement portion mounted on the bracket 55.

In order to access the rack 40 and the devices mounted in it, it is first disengaged from the lectern base 18 by unlocking the locking mechanism 58, such as by turning the thumbscrews to cause them to unscrew from the guide base 54. Once disengaged, the rack may be pulled rearwards using the handle 44, to the position shown in FIGS. 2 and 4 where the guide slider 56 is slid out of the channel of the guide base 54. At this point, the rack continues to be supported by its side rails 46 on the base 18 but is disengaged so that it can be easily lifted off of the base and removed completely from the interior of the lectern. In order to permit the rack to be supported in this manner, the length of the guide slider 56 and the length and location of the guide base 54 are configured to permit the rack 40 to be slid outwards from the lectern a sufficient distance such that when the two are disengaged, the rack is in its access position shown in FIG. 2 resting on the lectern base, thus preventing or inhibiting tipping. The access position of the rack 40 is chosen so that the center of gravity of the rack 40 (at least assuming the rack to be empty) is over the base 18, such that the rack does not tip rearwards out of the shell 12. In one embodiment, the guide base is approximately 6.0 inches long and is positioned approximately 1.875 inches from the rear edge of the lectern. The guide slider 56 is approximately 11.5 inches long.

The side rails 46 of the rack 40 have horizontal bottom flanges 60 that, when the rack 40 is mounted on the rack guide 52, rest on the base 18. The undersides of the flanges are coated with, or have attached thereto, a suitable low-friction or protective material, such as UHWM polyethylene tape sold by 3M, so that the rack 40 can then be slid out of the shell 12 easily without damaging the finish on the base 18. As may be seen from FIG. 2, the rear rail 48 is raised above the flanges 60 so that it will pass over the guide base 54 without the rack 40 needing to be lifted.

To reduce the risk of cables being pulled out of their sockets when the rack 40 is moved between the stowed and access positions, cable management grips 49 are provided on the rear rails 48 of the rack 40, and one or more cable management brackets 62 are mounted on the inside of the front panel 14.

It is contemplated that one or more power strips 70 may be mounted within the lectern cavity 13, such as on the inside surface of the front wall 14 or on the rack.

As mentioned above, the embodiment of the invention in the form of a lectern is merely one form of furniture that the invention can be used in. Those skilled in the art will readily appreciate that the invention is capable of being used in or as part of various type of furniture, such as cabinets, tables, credenzas, etc. No limitation of the scope of the invention is intended by this specific language used throughout, and the invention should be construed to encompass all embodiments that are contemplated by the following claims.

The invention claimed is:

1. A piece of furniture with a removable electronics rack, comprising:

a shell having a front wall, an open back, side walls, and a base attached to the front and the side walls, the shell defining an interior cavity;

a rack for electronic equipment removably mounted on the base within the interior cavity of the shell, the rack being slidable between a stowed position in which the rack is entirely within the internal cavity of the shell and an access position in which the rack extends through the open back and is partially outside the shell, the rack having a front rail with a handle extending outward from a surface of the front rail, two front vertical supports, each said front vertical support being attached at a bottom thereof to an end of the front rail and extending upward therefrom, two side rails, each said side rail being attached at one end to the bottom of one of the front vertical supports, and a rear rail; and at least one guide assembly for guiding the rack between the stowed position and the access position, the guide assembly configured to limit travel of the rack on the base to a horizontal direction, the guide assembly preventing removal of the rack from the base in the stowed position thereby securing the rack to the shell and preventing removal of the rack in a vertical direction until the rack is in the access position;

wherein the guide assembly includes a guide base mounted to the base of the shell, the guide base having an internal channel, and a guide slider mounted to a back surface of the front rail and projecting rearward from the front rail, the guide slider having an elongated shape that mates with the internal channel of the guide base so that the guide slider slides in to and out of the guide base, the elongated shape of the guide slider being sufficiently long to limiting the travel of the rack relative to the base to the horizontal direction until the elongated guide slider is no longer within the internal channel of the guide base.

2. The furniture of claim 1, wherein the rack includes two rear vertical rails, each said rear vertical rail being attached at a bottom thereof to an opposite end of the side rail from where the side rail is attached to the front vertical support.

3. The furniture of claim 1, wherein the guide assembly includes a locking mechanism for securing the front rail to the guide base.

4. The furniture of claim 3, wherein the locking mechanism is a thumbscrew threaded through the front rail and into a threaded hole in an upstanding bracket on the guide base.

5. The furniture of claim 1, wherein the rack in the access position is releasable from the furniture and, when released, can be lifted out of the opening.

6. The furniture of claim 5, wherein, at the access position when released, the rack rests on the base of the furniture with a center of gravity of the rack forward of a rear edge of the base.

7. The furniture of claim 5, wherein the side rails each have a lower flange configured to rest on the base when the rack is in the access position, each said lower flange having a bottom surface with a low-friction material disposed thereon.

8. The furniture of claim 5, wherein the front rail is attached to the side rails at a location spaced apart from the base at a location that permits the front rail to pass over the guide base while the rack is being slid on the base.

9. The furniture of claim 8, wherein the furniture is a lectern and wherein a top of the lectern is provided with a top surface for supporting materials used by a speaker using the lectern, the lectern has a wall raised above the top surface except on a rear side intended to face towards the speaker and away from the audience, and the opening is on the rear side.

10. The lectern of claim 9, wherein the lectern is mounted on wheels or casters.

* * * * *